US005406712A

United States Patent [19]

Slates

[11] Patent Number: 5,406,712

[45] Date of Patent: Apr. 18, 1995

[54] BOW HUNTING SIGHT

[75] Inventor: Scott O. Slates, Wentzville, Mo.

[73] Assignee: Toxonics Manufacturing, Inc., Wentzville, Mo.

[21] Appl. No.: 233,752

[22] Filed: Apr. 26, 1994

[51] Int. Cl.[6] ..... F41G 1/467

[52] U.S. Cl. ..... 33/265; 124/87

[58] Field of Search ..... 33/265, 241; 124/87

[56] References Cited

U.S. PATENT DOCUMENTS

| | | | |
|---|---|---|---|
| 3,310,875 | 3/1967 | Kowalski . | |
| 3,579,839 | 5/1971 | Kowalski | 33/265 |
| 3,822,479 | 7/1974 | Kowalski . | |
| 4,020,560 | 5/1977 | Heck | 33/265 |
| 4,535,747 | 8/1985 | Kudlacek . | |
| 4,543,728 | 10/1985 | Kowalski | 33/265 |
| 4,757,614 | 7/1988 | Kudlacek | 33/265 |
| 4,819,611 | 4/1989 | Sappington | 33/265 |
| 4,846,141 | 7/1989 | Johnson | 33/265 |
| 4,984,373 | 1/1991 | Forrest | 33/265 |
| 4,995,166 | 2/1991 | Knemeyer . | |
| 5,174,269 | 12/1992 | Sappington | 33/265 |

OTHER PUBLICATIONS

Ad from Golden Eagle Archery "It's More than a bow, it's system!" Discount Warehouse, Inc. Fall Edition 1991 Bowhunters no month.

Martin, no month 1992 Catalog, Worlds Leading Manufacturer of Archery Equipment.

*Primary Examiner*—Thomas B. Will

*Attorney, Agent, or Firm*—Paul M. Denk

[57] ABSTRACT

A bow hunting sight has a base defining a front, a back, sides, a top, and a bottom. At least one hole extends between the front and back of the base. The base further has at least one bore which extends generally perpendicular to, and intersecting with, the front-to-back hole. A carriage is pivotally and slidably received in the bore and is exposed through the front-to-back hole. The carriage has a threaded bore extending longitudinally therethrough through which an aiming pin is threadably received. A single set screw is used to lock the aiming pin against both pivotal and axial movement. The set screw is movable between a locking position in which the set screw urges the carriage inwardly to urge the aiming pin against a surface of the front-to-back hole to prevent both pivotal and axial movement of the pin and an unlocked position in which the carriage may move axially in the bore such that the aiming pin may be moved both pivotally and axially.

8 Claims, 2 Drawing Sheets

BOW HUNTING SIGHT

BACKGROUND OF THE INVENTION

This invention relates to bow hunting sights, and, in particular, to a hunting sight having a single locking means which locks the aiming pins in place.

Bow hunting sights typically include a base which supports a plurality of aiming pins. The aiming pins generally may be moved axially with respect to the sight and pivoted with respect to the sight to adjust the pins for desired distances. The hunting sights commercially available have two or more screws which are used to lock the aiming pin in place. One screw is used to lock the aiming pin against axial movement and another is used to lock the aiming pin against pivotal movement. Such a sight is shown in my U.S. Pat. No. 5,174,269.

As can be appreciated, the use of two screws, although not complicated can be improved upon and a one screw system with a carriage can be made. Further, it will be evident that a one-screw system will be less expensive to produce because the number of required parts will be reduced, as will the complexity of the machining of the base.

SUMMARY OF THE INVENTION

One object of this invention is to provide a hunting bow sight with an improved locking means for locking the aiming pins against both axial and pivotal movement.

Another object is to provide such a bow sight which uses a single locking means to lock the pin against movement.

Another object is to provide such a sight which is simple to operate.

Another object is to provide such a sight which is economical to produce.

These and other objects will become apparent to those skilled in the art in light of the following disclosure and accompanying drawings.

Briefly stated, a hunting bow sight of the present invention has a base defining a front, a back, sides, a top, and a bottom. At least hole extends between the front and back of the base. The base further has at least one bore which extends generally perpendicular to, and intersects with, the front-to-back hole. A carriage is pivotally and slidably received in the bore and is exposed through the front-to-back hole. The carriage has a threaded bore extending longitudinally therethrough. An aiming pin is threadably received in the carriage bore. A single set screw is used to lock the aiming pin against both pivotal and axial movement. The set screw is movable between a locking position in which the set screw urges the carriage inwardly to urge the aiming pin against a surface of the front-to-back hole to prevent both pivotal and axial movement of the pin and an unlocked position in which the carriage may move axially in the bore such that the aiming pin may be moved both pivotally and axially.

DESCRIPTION OF THE PREFERRED EMBODIMENT

Figure 1:
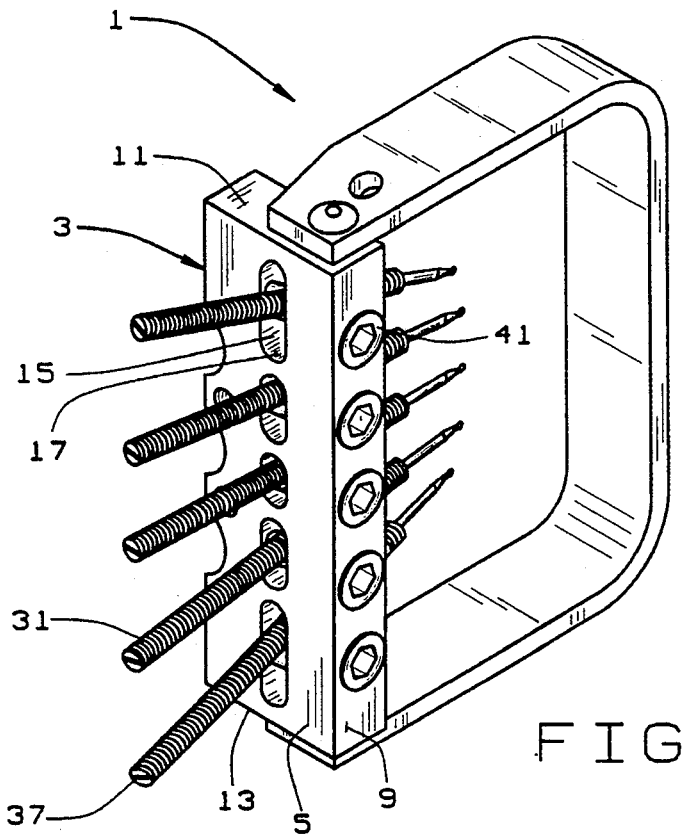
FIG. 1 is a perspective view of a hunting bow sight of the present invention.
Figure 2:
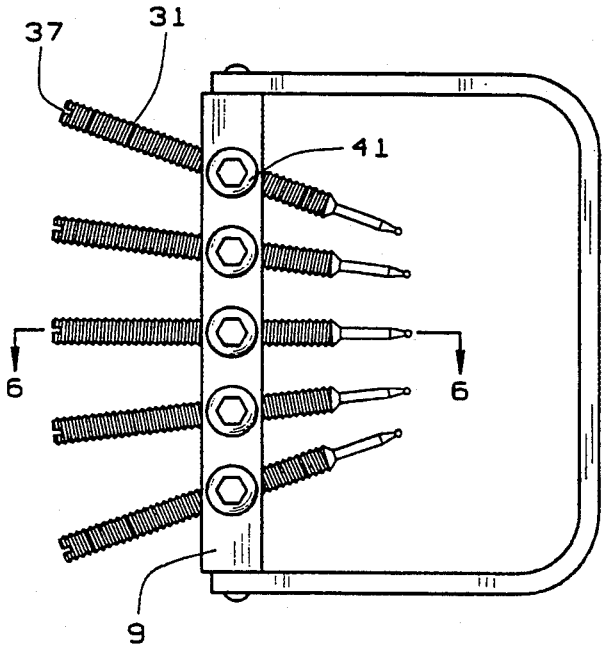
FIG. 2 is a side elevational view of the sight.

Referring now to FIGS. 1–7, reference numeral 1 indicates one illustrative embodiment of a hunting bow sight of the present invention. Sight 1 includes a base 3 having a front 5, a back 7, sides 9, a top 11, and a bottom 13. At least one hole 15, having a surface 17, is formed in base 3 and extends between the front 5 and back 7 of the base. At least one bore 19 is formed extending inwardly from a side 9 of base 3. Bore 19 is generally perpendicular to, and intersects with, front-to-back hole 15. Bore 19 has a first section 21, extending between side 9 and hole 15, which is threaded. A second portion 23 of the bore extends inwardly from the hole 15 and forms a blind bore.

A generally cylindrical carriage 25 is slidably received in bore 19. Carriage 25 has a diameter sized so that it may easily rotate within bore 19. The carriage has a reduced diameter section 26 at the back thereof. Carriage 25 is of a sufficient length that, when urged inwardly into bore portion 23, the carriage is still received within first bore portion 21. Carriage 25 preferably has an axial bore 27 such that the carriage is substantially hollow. A lateral bore 29 extends through the carriage, generally perpendicular to bore 27 and to the carriage's longitudinal axis. Bore 29 is preferably threaded and is situated on carriage 25 so as to be exposed in base hole 15.

Figure 3:
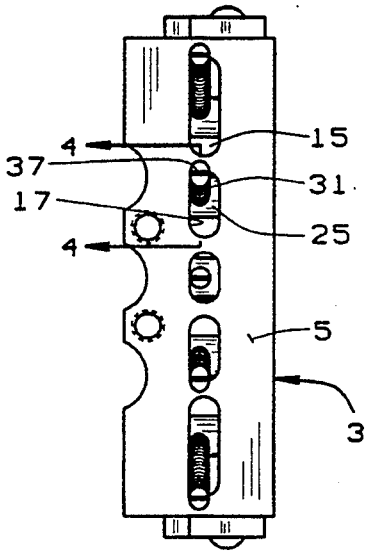
FIG. 3 is a back elevational view of the sight.
Figure 4:
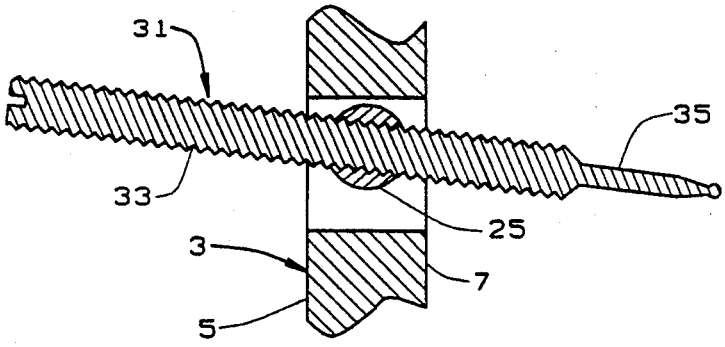
FIG. 4 is a cross-sectional view of the sight taken along line 4—4 of FIG. 3 showing an aiming pin in a first position.
Figure 5:
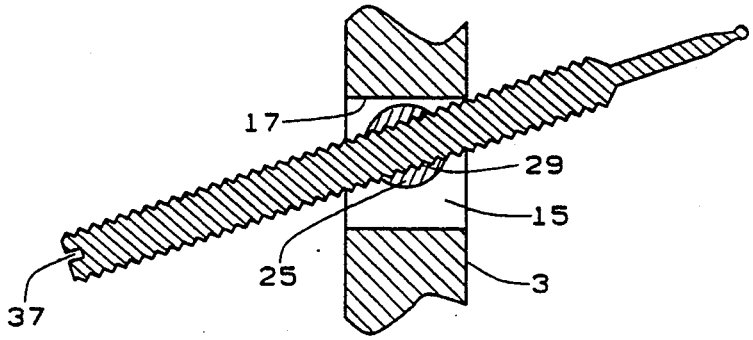
FIG. 5 is a cross-sectional view of the sight similar to FIG. 4, showing the aiming pin in a second position pivoted from the first position.
Figure 6:
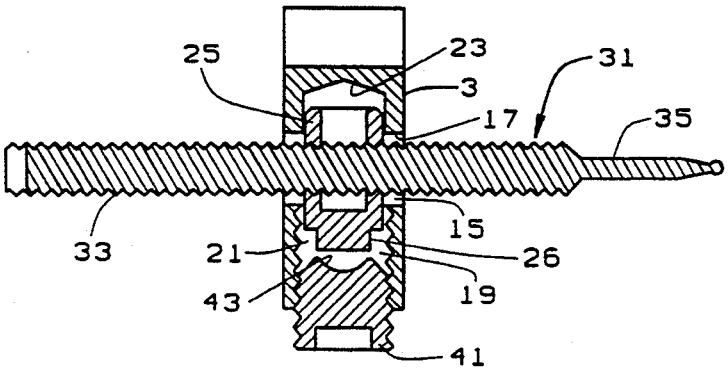
FIG. 6 is a cross-sectional view of the sight taken along line 6—6 of FIG. 2 showing the sight in a locked position.
Figure 7:
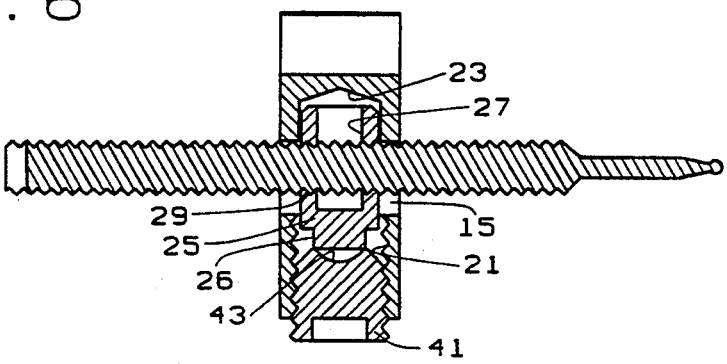
FIG. 7 is a cross-sectional view of the sight similar to FIG. 6 showing the sight in an unlocked position.

An aiming pin 31 is threadibly received in bore 29 to extend through base hole 15. Pin 31 has a threaded body 33 which narrows down at its tip 35 to define an aiming portion. Body 33 is threaded substantially for its entire length, and thus the extent to which pin tip 35 extends beyond hole 15 can be varied by screwing the pin body to a desired location along it length through carriage 25. Pin 31 has a slit 37 formed at its back end. Slit 37 may receive a blade of a screw driver or the like to facilitate positioning of the pin 31 on carriage 25. Preferably, however, the fit between the carriage and the pin is not so tight as to require a tool, and the positioning of the pin 31 in carriage 25 can be performed by hand. Because carriage 25 may pivot within bore 19, aiming pin 31 is also rotatably movable between positions, as is shown in FIGS. 4 and 5. Preferably, hole 15 is elongate, as shown in FIGS. 1 and 3, to give pins 31 a large degree of movement.

A set screw 41 is received in bore first portion 21. Set screw 41 is sized, along with carriage 25, so that when set screw 41 is screwed into bore 19, it urges carriage 25 inwardly sufficiently far to wedge aiming pin 31 against surface 17 of hole 15, as shown if FIGS. 5 and 7. Set screw 41 has a concave front surface 43 which receives the end of carriage reduced section 26. In this position, the set screw is in a "locking position" and prevents both pivotal and axial movement of pins 31 so that their settings may not be easily changed. By loosing screw 41, carriage 25 is give a freedom to move axially, and pin 31 is no longer wedged against surface 17. In this position, shown in FIG. 6, the relative position of aiming pin 31 can be changed. Thus, one locking element is used to control both pivotal and axial movement of pin 31. This eliminates the complexity of in field adjustments required of two screw systems. This is especially true when it is considered that a sight may have three or more pins which may need adjustment. The sight of the present invention allows for fast and easy adjustment of all the pins of the sight. Further, the use of the slidable carriage which threadibly receives the aiming pin and the set screw which locks the aiming pin allows for the archer to easily make fine adjustments in both the pivotal and axial position of the aiming pin.

Variations within the scope of the appended claims may be apparent to those skilled in the art. For example, rather than using a set screw to move the carriage and pin against the hole wall 17, a toggle switch could be used to achieve the same function. This would eliminate the need for a screw driver or allen wrench in the field to adjust the aiming pins 31. This example is merely illustrative.

I claim:

1. A bow hunting sight having a base defining a front, a back, sides, a top, and a bottom, at least one front-to-back hole extending between the base front and back, and at least one bore generally perpendicular to and intersecting with said front-to-back hole at least one carriage pivotally and slidably received in said bore to be exposed in said front-to-back hole, said carriage having a threaded bore extending longitudinally therethrough, said threaded bore being exposed in said front-to-back hole;

at least one aiming pin, said aiming pin having a threaded section, said aiming pin being threadably received in said threaded bore; and at least one single locking means for locking said aiming pin against both pivotal and axial movement, said single locking means being switchable between a locking position in which said carriage is slid axially to urge said aiming pin against a surface of said front-to-back hole to prevent both pivotal and axial movement of said pin and an unlocked position in which said carriage may slide axially in said base bore such that said aiming pin may be moved both pivotally and axially.

2. The hunting sight of claim 1 wherein said single locking means includes a set screw which is received in said base axially of said carriage to urge said carriage inwardly to said locking position when said set screw is tightened, and which releases said carriage from said locking position when said set screw is loosened.

3. The hunting sight of claim 2 wherein said set screw has a front end having a generally concave surface, said carriage has a back section having a reduced diameter, said reduced diameter section of said carriage being received in said concave surface of said set screw.

4. The hunting sight of claim 1 wherein said locking means is separate from said carriage.

5. The hunting sight of claim 1 wherein said aiming pin includes a body section and a pin section, said body being substantially fully threaded such so that it may be selectively positioned in the carriage along its entire length.

6. The hunting sight of claim 5 wherein said front-to-back hole is generally elongate, extending vertically of said base.

7. A bow hunting sight having a base defining a front, a back, sides, a top, and a bottom, a plurality of elongate front-to-back holes extending between the base front and back, and a plurality of bores generally perpendicular to and intersecting with said front-to-back holes, there being one bore for each front-to-back hole a plurality of carriages, each of said carriages being pivotally and slidably received in a respective one of said bores to be exposed in said front-to-back hole, each of said carriages having a threaded bore extending longitudinally therethrough, said threaded bore being exposed in said front-to-back hole;

a plurality of aiming pins, each of said aiming pins having a body and a pin section, said body being substantially completely threaded, to be threadably received in a respective one of said carriages; and a plurality of set screws, each of said set screws being received in a respective one of said base bores axially of said carriage for locking said aiming pin against both pivotal and axial movement, said set screws being switchable between a locking position in which said carriage is moved axially to urge said aiming pin against a surface of its associated front-to-back hole to prevent both pivotal and axial movement of said pin and an unlocked position in which said carriage may move axially in said base bore such that said aiming pin may be moved both pivotally and axially.

8. The hunting sight of claim 7 wherein each of said set screws has a front end having a generally concave surface, each of said carriages has a back section having a reduced diameter, said reduced diameter section of said carriage being received in said concave surface of said set screw.

* * * * *